United States Patent [19]

Lin et al.

[11] 4,205,288

[45] May 27, 1980

[54] TRANSFORMER WITH PARALLEL MAGNETIC CIRCUITS OF UNEQUAL MEAN LENGTHS AND LOSS CHARACTERISTICS

[75] Inventors: Kou C. Lin, Hermitage; Belvin B. Ellis, Pulaski; Charles E. Burkhardt, Sharon, all of Pa.

[73] Assignee: Westinghouse Electric Corp., Pittsburgh, Pa.

[21] Appl. No.: 956,142

[22] Filed: Oct. 27, 1978

[51] Int. Cl.[2] ..... H01F 33/00; H01F 27/24

[52] U.S. Cl. ..... 336/5; 336/212; 336/218; 336/233

[58] Field of Search ..... 336/211, 212, 213, 217, 336/218, 216, 219, 155, 160, 233, 234, 178, 5, 10, 12; 323/89

[56] References Cited

U.S. PATENT DOCUMENTS

| | | | |
|---|---|---|---|
| 1,698,634 | 1/1929 | Johannesen | 336/212 |
| 1,731,861 | 10/1929 | McRell | 336/219 |
| 1,805,534 | 5/1931 | Troy | 336/216 |
| 1,896,762 | 2/1933 | Whittle | 336/234 |
| 1,910,253 | 5/1933 | Keinath | 336/234 X |
| 1,982,344 | 11/1934 | Kinnard | 336/155 |
| 2,145,703 | 1/1939 | Wirz | 336/160 |
| 2,387,943 | 10/1945 | Putman | 336/212 |
| 2,465,798 | 3/1949 | Granfield | 336/234 |
| 2,818,545 | 12/1957 | Lamm | 323/89 |
| 2,932,787 | 4/1960 | Krabbe et al. | 323/89 |
| 2,982,948 | 5/1961 | Brownlow | 336/233 X |
| 3,153,214 | 10/1964 | Brutt et al. | 336/213 |
| 3,157,866 | 11/1964 | Lien | 336/233 X |
| 3,170,133 | 2/1965 | Kernick | 336/211 X |
| 3,252,119 | 5/1966 | Graham | 336/217 |
| 3,290,633 | 12/1966 | Kuriyama et al. | 336/212 X |
| 3,315,087 | 4/1967 | Ingenito | 336/233 X |
| 3,454,916 | 7/1969 | Hoover | 336/212 X |
| 3,739,255 | 6/1973 | Leppert | 336/212 X |
| 3,748,618 | 7/1973 | Kaiserswerth et al. | 336/212 X |
| 3,878,495 | 4/1975 | Thomas | 336/212 |
| 4,088,942 | 5/1978 | Miko | 336/160 X |

FOREIGN PATENT DOCUMENTS

| | | | |
|---|---|---|---|
| 605532 | 4/1932 | Fed. Rep. of Germany | 336/233 |
| 28423 | 3/1956 | Fed. Rep. of Germany | 336/234 |
| 1813643 | 6/1970 | Fed. Rep. of Germany | 336/233 |
| 495866 | 11/1938 | United Kingdom | 336/233 |

*Primary Examiner*—Thomas J. Kozma
*Attorney, Agent, or Firm*—D. R. Lackey

[57] ABSTRACT

An electrical transformer having an electrical winding and a magnetic core having two parallel magnetic circuits having unequal mean lengths. The shorter of the parallel magnetic circuits is constructed of a magnetic material which exhibits a lower loss characteristic than the magnetic material used in the longer of the parallel magnetic circuits, at like levels of induction.

4 Claims, 7 Drawing Figures

TRANSFORMER WITH PARALLEL MAGNETIC CIRCUITS OF UNEQUAL MEAN LENGTHS AND LOSS CHARACTERISTICS

BACKGROUND OF THE INVENTION

1. Field of the Invention

The invention relates in general to electrical transformers, and more specifically to electrical power and distribution transformers used in the transmission and distribution of electrical energy.

2. Description of the Prior Art

Magnetic materials used in the magnetic cores of electrical power and distribution transformers have been improved greatly over the years, enabling the size and manufacturing costs of a transformer to be reduced. In general, the electrical steels used in transformers may be classified as: (1) hot rolled, non-grain oriented steels, such as AISI types M-14, M-15, M-17 and M-19; (2) cold rolled grain oriented silicon steels, such as AISI types M-4 through M-8 hereinafter referred to as regular B steels; and (3) high permeability grain oriented silicon steel, hereinafter referred to as high B steels, which are doped with various dopants to provide a $B_{10}$ value in excess of 18.5 KG, compared with 17 to 17.5 KG for regular B steels.

The non-grain oriented steels of class (1) give a very poor performance when used in power and distribution transformers, and thus their usage is confined to small control and speciality transformers. The high B steels of class (3) above, cost more to produce and thus are more costly than regular B steels. While magnetic cores constructed of high B steels exhibit lower core losses than similar magnetic cores constructed of regular B materials, their higher initial cost generally more than offsets their advantages, and thus the regular B steels of class (2) above, are presently used for most of the power and distribution transformers manufactured at the present time.

SUMMARY OF THE INVENTION

Briefly, the present invention is a new and improved electrical transformer having electrical windings disposed in inductive relation with a magnetic core. The magnetic core is constructed of two different grades of magnetic materials, from the core loss viewpoint, with the magnetic core being constructed such that the two different materials create parallel magnetic circuits. The magnetic core is further constructed such that the magnetic circuits formed by the different loss materials have different mean lengths, with the shorter magnetic circuit being constructed of the better grade, i.e. lower loss, magnetic material.

The losses in the magnetic core are the sum of the hysteresis and eddy current losses. While these losses are not directly related to the magnetic permeability of the steel, in general it may be said that core losses for a given induction decrease as the permeability of the steel used is increased. Thus, instead of referring to the different materials used in the magnetic core of the invention as different loss materials, they may also be referred to as materials having different magnetic permeabilities at like levels of induction.

The composite magnetic core of the invention is the result of the surprising and unexpected discovery that the core losses in transformers constructed according to the teachings of the invention are not directly proportional to the ratio of the losses and the amounts of the two different materials used. Instead, the core losses are almost as low as if the whole magnetic core had been constructed of the "better" magnetic material, even when the better magnetic material represents only about 30% of the total weight of the magnetic core. This discovery, for example, enables transformers to be constructed with core losses comparable with the low core losses obtainable with the high B steels, while using only about 30% by weight of a high B steel, with the remainder of the core being a regular B steel.

Applying the teachings of the invention to a wound core, for example, the inner lamination turns would be formed of the "better" magnetic material, and the outer lamination turns would be formed of the higher loss material. Applying the teachings of the invention to a stacked core, for example, would result in the normally used individual laminations which are assembled to provide a layer of laminations, being divided in their longitudinal direction. The divided lamination facing the center of the magnetic core would be formed of the "better" magnetic material, while the remaining divided lamination which faces the outside of the magnetic core would be formed of the higher loss magnetic material.

The invention enables smaller and lower cost transformers to be constructed for a particular transformer rating, without increasing the core losses, compared with prior art transformers of the same rating; or, if the dimensions are maintained the same as prior art transformers, transformers having lower losses may be constructed without incurring the economic penalty which would result if the whole magnetic core were to be constructed of the lower loss material.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Electrical transformers of the type which are used by the electrical utilities to transmit and distribute large blocks of electrical power, and by industry to stepdown distribution voltages, are designed to exhibit predetermined maximum losses in the magnetic core. The American Iron and Steel Institute (AISI) has typed the various hot rolled, and cold rolled regular B electrical steels with the letter M and a number which is roughly equal to ten times the maximum loss, in watts per pound, of the material, at an induction B of 17 to 17.5 KG, with a magnetizing force H of 10 oersteds. At this time, the high B steels have not been given a type designation by AISI.

The designer of an electrical transformer, therefore, can select the type of electrical steel necessary to meet the core loss requirements of the transformer under consideration. The core losses, also called TW, iron loss, and no-load loss, are measured in watts, and they are continuous and constant regardless of load. This loss consists of: (1) the energy required to alter pole orientation of the magnetic domain between $+B_{max}$ and $-B_{max}$, called the hysteresis loss, and (2) the eddy current or $I^2R$ loss due to the flow of circulating current induced into the magnetic core. The lower the M number of the steel, the lower the core loss, and the higher the initial cost of the electrical steel.

Recently, high B cold rolled grain oriented steels have been produced with even lower losses than M-4, by doping a 3.25% silicon steel with such dopants as Boron and aluminum nitrate. These steels are characterized by having an induction B usually in excess of 18.5 KG at a magnetizing force H of 10 oersteds, while the regular B steels, i.e. AISI types M-4 through M-8, have a $B_{10}$ value of 17 to 17.5 KG. Thus, the high B steels may be used to produce transformers having very low core losses, if the induction B is maintained the same as with regular B steels; or, the core size may be reduced and worked at higher inductions, to produce the same losses as cores with regular B steels. In general, however, the cost advantages in reducing the core size, which enables the size of the electrical windings to be reduced, the size of the tank to be reduced, etc, are more than offset by the higher cost of the higher B steels. Thus, the high B steels have not replaced the regular B steels, and they are used only on a limited, selective basis. The present invention enables the low losses of the magnetic core constructed of high B steel to be closely approached, while using only about 30 to 50% by weight of high B steel. The invention, however, is not limited to the "mixing" of high B and regular B steels, as it has advantages when applied to any transformer, wherein the magnetic core is constructed of two magnetic materials having different loss characteristics.

Figure 1:
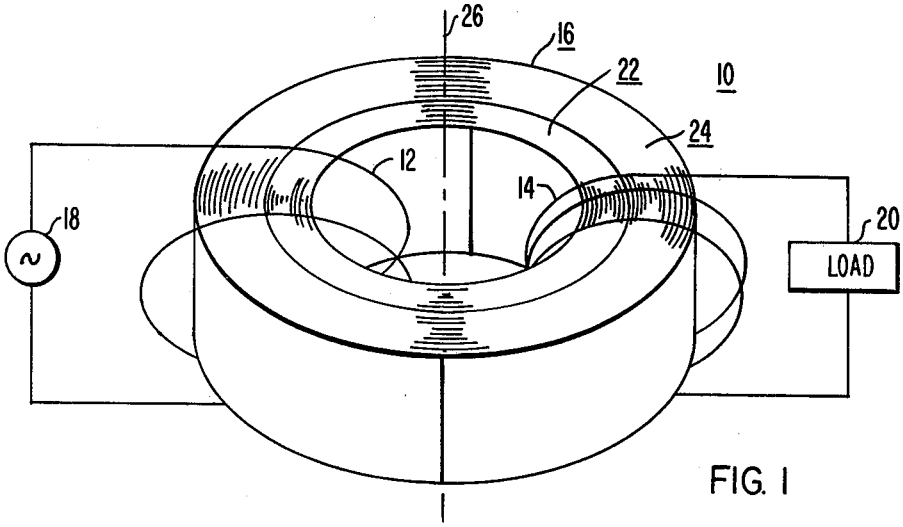
FIG. 1 is a partially schematic and partially diagrammatic perspective view of an electrical transformer constructed according to the teachings of the invention.

Broadly, the present invention is an electrical transformer having a composite magnetic core constructed of different loss magnetic materials arranged in parallel to define magnetic loops or circuits having different mean lengths. The "better" or lower loss of the different loss magnetic steels is used in the magnetic circuit having the smaller mean length. FIG. 1 illustrates a first embodiment of the invention, wherein the concept of the invention is applied to wound-type magnetic core construction.

More specifically, FIG. 1 is a partially schematic and partially diagrammatic view of an electrical transformer 10 having primary and secondary windings 12 and 14, respectively, disposed in inductive relation with a magnetic core 16 of the wound type. The primary winding 12 is adapted for connection to a source 18 of alternating potential, and the secondary winding 14 is adapted for connection to a load circuit 20.

Figure 2:
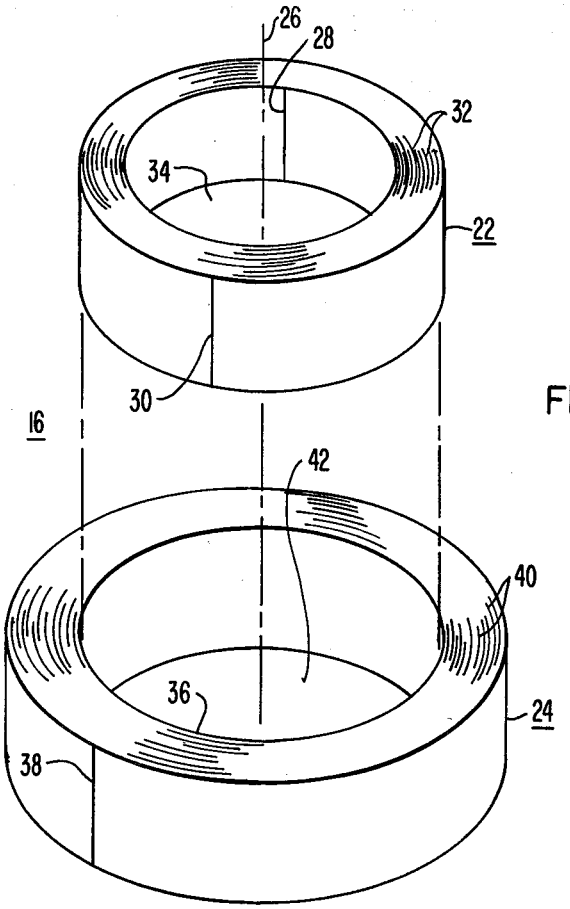
FIG. 2 is an exploded perspective view of the wound, composite magnetic core of the electrical transformer shown in FIG. 1.

The magnetic core 16, shown in an exploded perspective view in FIG. 2, is a composite magnetic core having inner and outer sections or loops 22 and 24 disposed in concentric adjacent relation about a common central axis 26. Sections 22 and 24 are constructed of magnetic sheet materials having different loss characteristics, or different magnetic permeabilities $\mu$ at like levels of induction with the lower loss or the higher $\mu$ material being used in the inner loop 22, and the higher loss or the higher $\mu$ material being used in the outer loop 24.

The magnetic sheet materials are wound to provide a plurality of superposed, nested turns, with the sheet material of loop 22 starting at 28 and ending at 30, creating a plurality of nested turns 32 which extend between an inner opening or window 34 and an outer surface which defines a predetermined outside diameter.

The sheet material of loop 24 starts at 36, adjacent to end 30 of the sheet material of loop 22, and it ends at 38, creating a plurality of nested turns 40 which extend between an opening 42 having an inside diameter which is substantially the same as the outside diameter of loop 22, and an outer surface which defines a predetermined diameter.

The composite magnetic core 16 may then be further processed, as required by the specific application, to provide the desired configuration, and openable joint, such as the configuration and step-lap joint disclosed in U.S. Pat. Nos. 3,307,132; 3,309,641; Re 26,296; and 3,965,717, all of which are assigned to the same assignee as the present application.

It should be noted that the inner and outer loops 22 and 24, respectively, define parallel magnetic circuits for the magnetic flux induced into the magnetic core 16 by the primary winding 12, and that the mean or average length of loop 22 is shorter than that of loop 24.

Figure 3:
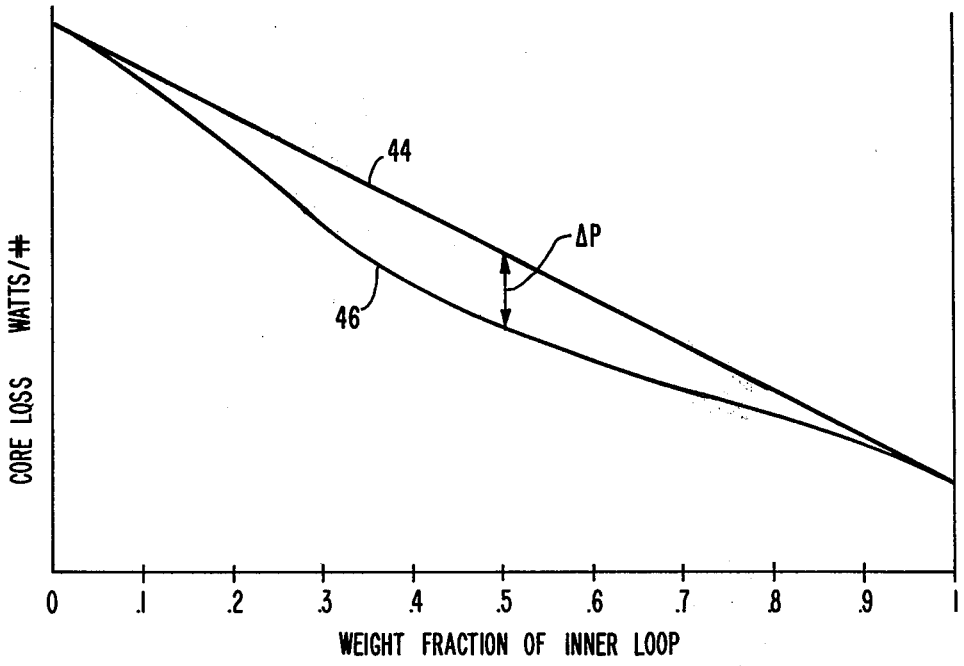
FIG. 3 is a graph which plots core loss versus weight fraction of the better magnetic material, for a transformer constructed according to the teachings of the invention.

FIG. 3 is a graph which plots core loss in watts per pound versus the weight fraction of the inner loop 22, using a high B steel, such as Armco's TRAN COR H, in the inner loop, and regular B steel, such as M-5 in the outer loop 24. The straight line 44 in the graph of FIG. 3 indicates the loss characteristic which would be expected by mixing the two different loss magnetic materials, while the curved line 46 indicates the actual loss characteristics of such a composite magnetic core. The vertical difference $\Delta P$ between curves 44 and 46 indicates the loss advantage achievable for the specific weight fraction of the inner loop selected.

Figure 4:
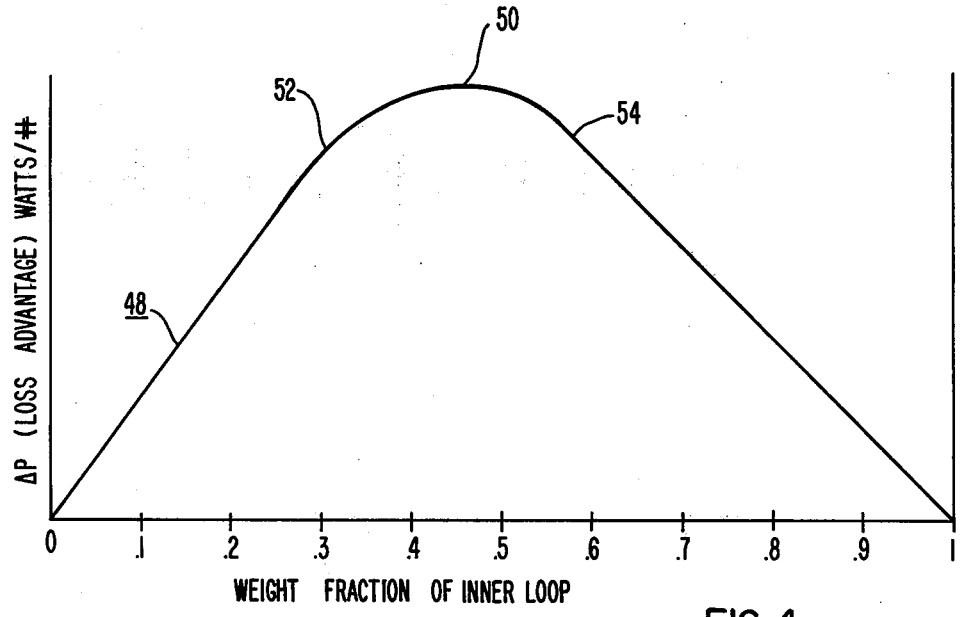
FIG. 4 is a graph which plots the core loss advantage versus the weight fraction of the better magnetic material, taken from the graph of FIG. 3.

FIG. 4 is a graph which plots the loss advantage $\Delta P$ of FIG. 3 versus the weight fraction of the inner loop. It will be noted that the resulting curve 48 peaks at a point 50, which is between the weight fractions of about 0.4 to 0.5, and that the curve 48 flattens between points 52 and 54 which represent weight fractions of about 0.3 and 0.6, respectively. Thus, the weight fraction of the inner loop would be at least 0.3, in order to obtain the advantages of the invention, and for economic reasons, it should not exceed about 0.5 to 0.6.

Figure 5:
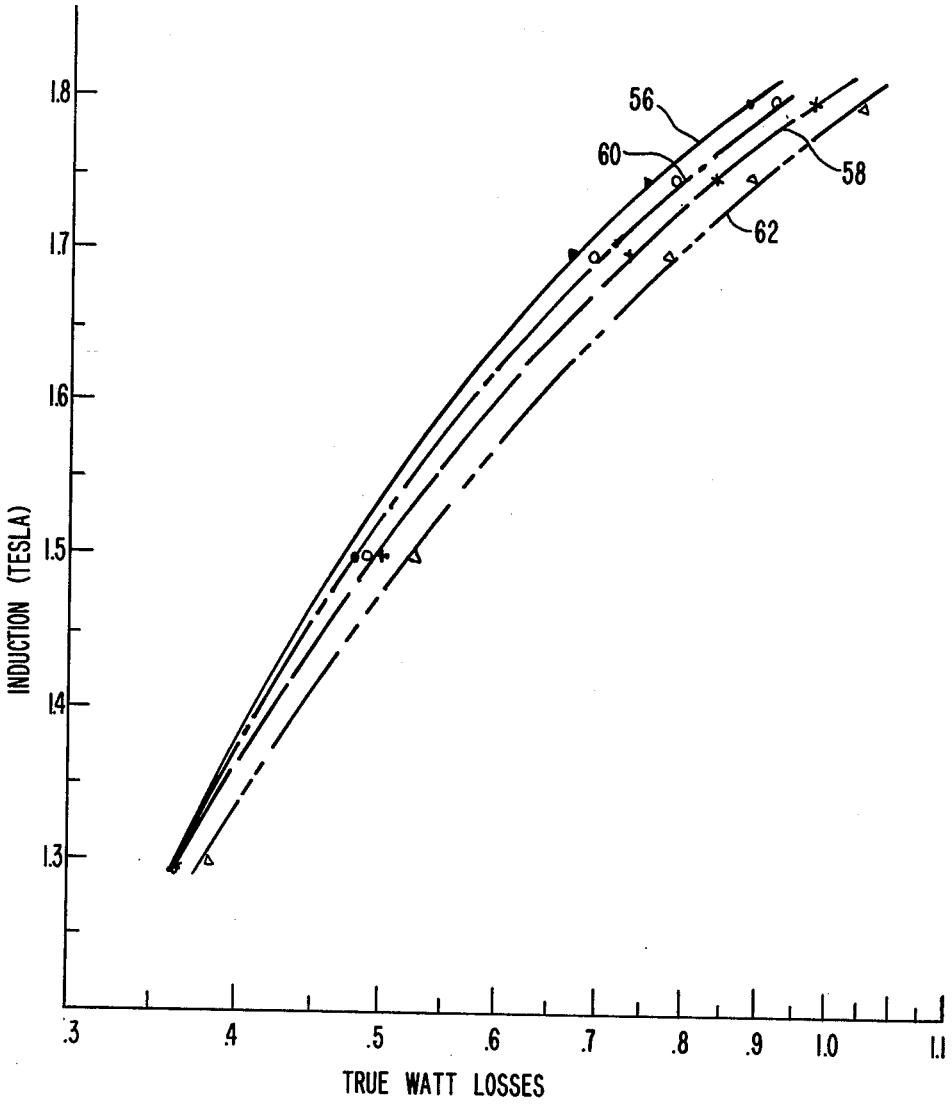
FIG. 5 is a graph which plots induction versus core loss for four magnetic cores constructed with all high B material, with all regular B material, and composite cores constructed of high and regular B material.

FIG. 5 is a graph which illustrates the true watt losses per pound versus induction, of four ring-type wound cores, all of which are wound of five-inch wide, 12 mil thick magnetic materials. High B and regular B steels are each wound to form inner and outer loops, as illustrated in FIG. 2, with the inside diameter of the inner loop being 5.5 inches. Each of the inner and outer loops had a one inch build. This is a weight fraction of 0.43 for the inner loop. The inner and outer loops of the high B and regular B materials were interchanged and the core losses measured, with curve 56 indicating the watts lost per pound of a magnetic core wherein both the inner and outer loops are constructed of the high B magnetic material. Curve 58 indicates the watts lost per pound of a magnetic core wherein both the inner and outer loops are constructed of regular B magnetic material. Curve 60 indicates the watts lost per pound of a magnetic core constructed according to the teachings of the invention wherein the inner loop is constructed of the high B material, and the outer loop of the regular B material. Curve 62 indicates the watts lost per pound for a magnetic core constructed of regular B material in the inner loop and high B material in the outer loop. It will be noted that curve 60, representing the magnetic core constructed according to the teaching of the invention, has a loss characteristic over the complete range of induction which is closer to curve 56 associated with the high B material, than curve 58 associated with the regular B material. Curve 62 indicates that placing the better material in the longer of the two loops produces even higher losses than those of a magnetic core which is constructed entirely of the low B material.

Figure 6:
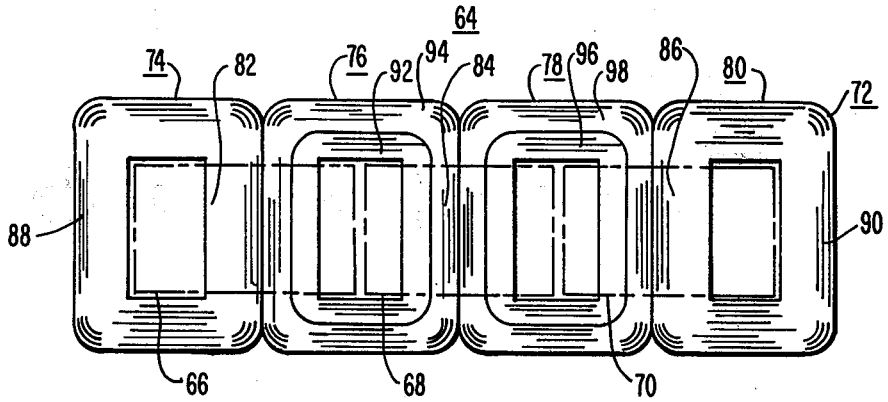
FIG. 6 is an elevational view of a three-phase transformer, constructed according to the teachings of the invention.

FIG. 6 is an elevational view of a three-phase transformer 64 constructed according to the teachings of the invention, having phase winding assemblies 66, 68 and 70 disposed in inductive relation with a magnetic core 72. Magnetic core 72 is constructed of four wound magnetic cores 74, 76, 78 and 80 which are disposed in side-by-side relation to provide winding legs 82, 84 and 86 for phase winding assemblies 66, 68 and 70, respectively, and outer legs 88 and 90. The inner cores 76 and 78 are composite magnetic cores with core 78 having inner and outer loops 92 and 94, respectively, and core 78 having inner and outer loops 96 and 98, respectively. The inner loops 92 and 96 are constructed of lower loss magnetic material than the magnetic material used in the outer loops 94 and 98. The outer magnetic cores 74 and 80 are constructed of the same material as the outer loops 94 and 98.

The core loss in a five-legged, three-phase wound type transformer is about 35% greater than for a single-phase transformer of the same rating. The construction set forth in FIG. 6 will significantly improve the destruction factor.

While the teachings of the invention are easier to implement with wound-type core construction, they may also be applied to stacked-type core construction.

Figure 7:
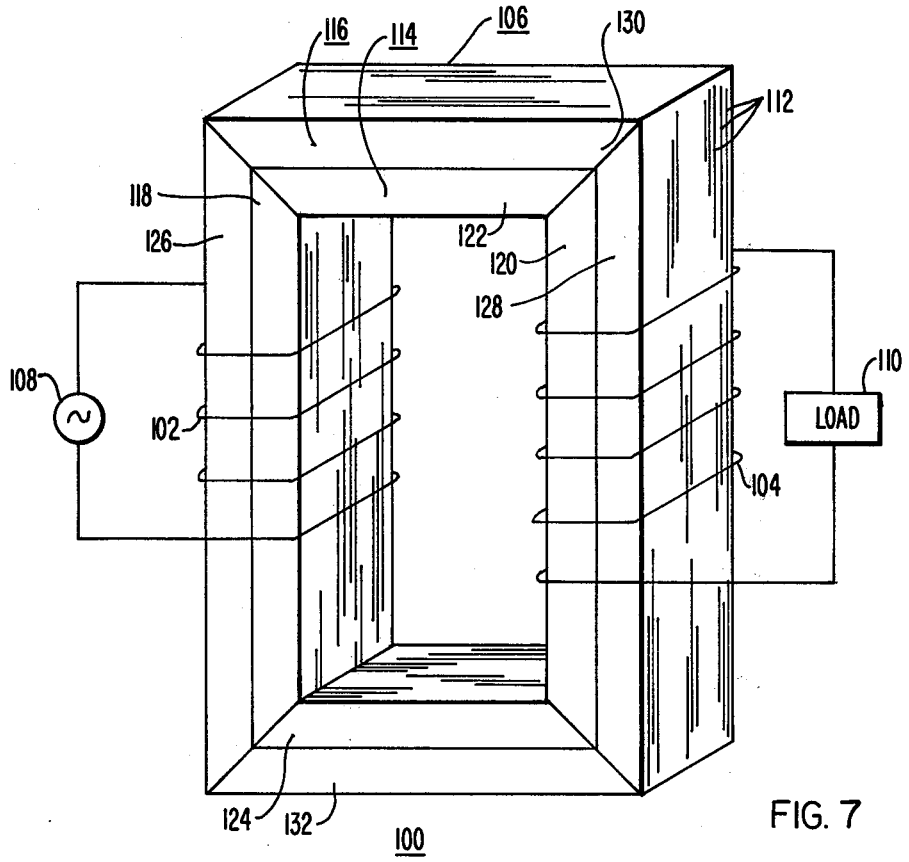
FIG. 7 is a partially schematic and partially diagrammatic perspective view of an electrical transformer constructed according to another embodiment of the invention.

FIG. 7 is a partially schematic and partially diagrammatic perspective view of a transformer 100 constructed according to an embodiment of the invention which utilizes a stacked-type magnetic core. More specifically, transformer 100 includes primary and secondary windings 102 and 104, respectively, disposed to induce the magnetic flux into a magnetic core 106. Primary winding 102 is adapted for connection to a source 108 of alternating potential, and secondary winding 104 is adapted for connection to a load circuit 110.

Magnetic core 106 is a composite magnetic core having a plurality of superposed layers 112 of magnetic laminations. Each layer 112 of laminations includes inner and outer loops or magnetic circuits 114 and 116, respectively, constructed of magnetic materials having different loss characteristics or different permeabilities, with the inner loop 114 being constructed of the lower loss material. The inner loop 114 includes first and second leg laminations 118 and 120, respectively, and upper and lower yoke laminations 122 and 124, respectively. The outer loop includes first and second leg laminations 126 and 128, respectively, and upper and lower yoke laminations 130 and 132, respectively. Leg laminations 118 and 126 are assembled in side-by-side relation to provide a composite lamination for one of the winding legs, and leg laminations 120 and 128 are assembled in side-by-side relation to provide a composite lamination for the other of the winding legs. In like manner, upper yoke laminations 122 and 130 are assembled in side-by-side relation, and lower yoke laminations 124 and 134 are assembled in side-by-side relation, to provide composite upper and lower yoke laminations, respectively.

Transformer 100 will exhibit significantly lower losses than a transformer having a magnetic core constructed entirely of the higher loss, or lower B material, using the same core dimensions. Or, transformer 100 may be constructed with smaller magnetic core dimensions, to work the iron at a higher induction, while exhibiting the same losses as a larger magnetic core constructed entirely of the higher loss material. Reducing the size of the magnetic core 106 results in enabling smaller windings to be used, which cuts down on the tank size, and the amount of cooling fluid required.

The stacked construction shown in FIG. 7 may be used to provide a five-legged, three-phase magnetic core having four magnetic core sections, similar to that of a wound five-legged magnetic core construction shown in FIG. 6. The inner two magnetic cores would be constructed as shown in FIG. 7 wherein the inner loops are constructed of lower loss magnetic material than the magnetic material used in the outer loops, and wherein the outer two magnetic core sections are constructed of the same material used in the outer loops of the inner core sections.

We claim as our invention:

1. An electrical power transformer for transmitting and distributing electrical power in an electrical power system, comprising:

a magnetic core devoid of non-magnetic gaps, said magnetic core being constructed to provide inner and outer parallel, concentrically adjacent, magnetic circuits, said inner and outer magnetic circuits being constructed of magnetic materials having different loss characteristics at like inductions, with the inner magnetic circuit being constructed of the material having the lower loss characteristic, said outer magnetic circuit being constructed of a first grain oriented, regular B, electrical steel, said inner magnetic circuit being constructed of a second grain oriented, high B, electrical steel having a higher permeability at like levels of induction, and a higher $B_{10}$ value, than said first grain oriented electrical steel, with said second grain oriented electrical steel having a $B_{10}$ value of at least 18.5 KG, and first and second electrical windings each disposed to link both said inner and outer magnetic circuits, said first and second electrical windings being adapted for connection to a source of electrical potential and to a load circuit, respectively, said inner magnetic circuit being constructed to provide 30 to 60% of the weight of said magnetic core to provide a lower overall core loss in watts per pound than the selected weight ratio would indicate, based upon the core losses of each of the first and second grain oriented electrical steels when used alone.

2. The electrical transformer of claim 1 wherein the magnetic core is a wound magnetic core constructed of a plurality of superposed, nested turns of magnetic sheet material, with the inner and outer magnetic circuits defining inner and outer concentrically adjacent sections of said wound magnetic core.

3. The electrical transformer of claim 1 wherein the magnetic core is a stacked magnetic core, having a plurality of superposed layers of magnetic laminations, and the inner and outer parallel magnetic circuits include stacked magnetic core sections, respectively, each constructed of superposed layers of sheet laminations, with said stacked magnetic core sections being disposed in concentric adjacent relation.

4. An electrical power transformer for transmitting and distributing electrical power in an electrical power system, comprising:

a three-phase magnetic core devoid of non-magnetic gaps having first, second, third and fourth core sections disposed in side-by-side relation in the recited order to provide three winding legs and two outer legs, each of said second and third core sections being constructed to define inner and outer parallel, concentrically adjacent magnetic circuits, said inner and outer parallel magnetic circuits being constructed of magnetic material having different loss characteristics at like levels of induction, with the inner magnetic circuit being constructed of a magnetic material having the lower loss characteristic, said first and fourth core sections, and the outer magnetic circuits of said second and third core sections being constructed of a first grain oriented, regular B, electrical steel, said inner magnetic circuits of the second and third core sections being constructed of a second grain oriented, high B, electrical steel having a higher permeability at like levels of induction, and a higher $B_{10}$ value, than said first grain oriented electrical steel, with said second grain oriented electrical steel having a $B_{10}$ value of at least 18.5 KG, and electrical windings on each of said three winding legs, with certain of said electrical windings being adapted for connection to a three-phase source of electrical potential, and certain of said electrical windings being adapted for connection to a load circuit, said inner magnetic circuit of the second and third core sections each being constructed to provide 30 to 60% of the weight of its associated core section, to provide a lower overall core loss in watts per pound than the selected weight ratio would indicate, based upon the core losses of each of the first and second grain oriented electrical steels when used alone.

* * * * *